United States Patent [19]

Kimura et al.

[11] Patent Number: 4,696,628

[45] Date of Patent: Sep. 29, 1987

[54] SCROLL-TYPE FLUID TRANSFERRING MACHINE WITH INTAKE PORT AND SECOND INTAKE PASSAGE

[75] Inventors: Tadashi Kimura; Masahiro Sugihara; Tsutomu Inaba, all of Wakayama, Japan

[73] Assignee: Mitsubishi Denki Kabushiki Kaisha, Tokyo, Japan

[21] Appl. No.: 847,524

[22] Filed: Apr. 3, 1986

[30] Foreign Application Priority Data

May 16, 1985 [JP] Japan ..... 60-106304

[51] Int. Cl.[4] ..... F01C 1/04

[52] U.S. Cl. ..... 418/15; 418/55; 418/94

[58] Field of Search ..... 418/15, 55, 94

[56] References Cited

U.S. PATENT DOCUMENTS 4,496,293 1/1985 Nakamura et al. ..... 418/55

4,564,339 1/1986 Nakamura et al. ..... 418/55

FOREIGN PATENT DOCUMENTS 103980 6/1984 Japan .

110893 6/1984 Japan .

*Primary Examiner*—John J. Vrablik

*Attorney, Agent, or Firm*—Oblon, Fisher, Spivak, McClelland & Maier

[57] ABSTRACT

A throttle portion is formed in an intake port in a stationary scroll member to suppress an abnormal pressure rise which may take place when a refrigerant is sucked in the intake port, and a communication hole for communicating a low pressure space in a shell with a space inside an oldham's coupling, the inner space being formed by a recess of a bearing frame, the outer peripheral wall of the base plate of an oscillatable scroll member and the side surface of the wrap of the stationary scroll member.

3 Claims, 10 Drawing Figures

SCROLL-TYPE FLUID TRANSFERRING MACHINE WITH INTAKE PORT AND SECOND INTAKE PASSAGE

BACKGROUND OF THE INVENTION

The present invention relates to a scroll-type fluid transferring machine provided with an oldham's coupling for effecting oscillation of an oscillatable scroll member.

First of all, before starting explanation of the scroll-type fluid transferring machine, the principle of the machine will be briefly described.

FIG. 3 shows structural elements essential to a scroll-type fluid transferring machine used as a compressing machine and the principle of compression. In FIG. 3, a reference numeral 1 designates a stationary scroll member, a numeral 2 designates an oscillatable scroll member, a numeral 3 designates an intake port, a numeral 4 designates an outlet port, a numeral 5 designates a compression chamber, and a symbol 0 designates the center of the stationary scroll member 1.

The stationary scroll member 1 has a wrap 1*a* and oscillatable scroll member 2 has a wrap 2*a*. The shape of the wraps 1*a*, 2*a* is the same, but the direction of winding is inverse. The wraps 1*a*, 2*a* are formed by an involute curve or combination of circular arcs as well known.

The operation of the structural elements of the machine will be described. The stationary scroll member 1 is kept still and the oscillatable scroll member 2 is assembled to the stationary scroll member 1 with 180° phase-shifted condition so that the oscillatable scroll member is subjected to oscillation without rotation around the center O of the stationary scroll member 1. FIGS. 3*a* to 3*d* show relative movement of the stationary and oscillatable scroll members at angular positions of 0°, 90°, 180° and 270°. In the 0° angular position shown in FIG. 3*a*, gas is confined in the intake chamber 3 so that the compression chamber 5 is formed between the wraps 1*a*, 2*a*. As the oscillatable scroll member 2 moves, the volume of the compression chamber 5 is gradually reduced thereby compressing the gas, and finally, the compressed gas is discharged through the outlet port 4 formed at the central portion of the stationary scroll member 1.

FIG. 5 is a cross-sectional view of a conventional scroll-type compressor applied to a totally closed type refrigerant compressor, as disclosed in Japanese Patent Application No. 64586/1984.

In FIG. 5, a reference numeral 1 designates the stationary scroll member in which the wrap 1*a* is formed in one side of a base plate 1*b*, a numeral 2 designates the oscillatable scroll member in which the wrap 2*a* is formed in one side of a base plate 2*b*, a numeral 3 designates the intake port (intake chamber), a numeral 4 designates the outlet port, a numeral 5 designates the compression chamber formed between the wraps 1*a*, 2*a* which are mutually combined, a numeral 6 designates a main shaft, a numeral 7 designates an oil cap which is provided with a suction opening 8 and which is attached to the lower end of the main shaft so as to cover the lower end with a predetermined space, and numerals 9, 10 designate bearing frames. The bearing frame 9 is provided with a recess 11 in which the oscillatable scroll member 2 is oscillatably received. As clearly shown in a cross-sectioned view of FIG. 4, an oldham's coupling 12 comprises an annular ring member 12*a* and each pair of first and second pawls 13, 14. The first paired pawls 13 are formed on the upper surface of the annular ring member 12*a* at diametrically opposing positions, and the second paired pawls 14 are formed on the lower surface of the ring member 12*a* at diametrically opposing positions so that a line extending between the first paired pawls orthogonally intersects a line extending between the second paired pawls 14. The first pawls are slidably put in a pair of first grooves 15 formed in the lower surface of the base plate 2*b* of the oscillatable scroll member 2, and the second pawls 14 are slidably put in a pair of second grooves 16 formed in the recess 11 of the bearing frame 9 as shown in FIGS. 4 and 5, whereby the oscillatable scroll member 2 is engaged with the bearing frame 9 so that it is subjected only to oscillation. The oldham's coupling 12 is of a shape such that when it is placed in a space defined by the base plate 2*b* of the oscillatable scroll member 2 and the bearing frame 9, air gaps which may be formed at contacting surfaces between the base plate 2*b* and the oldham's coupling 12 and between the bearing frame 9 and the oldham's coupling 12 are minimized, whereby the first space 17 formed at the inner circumferential side of the oldham's coupling 12 is isolated from the second space 18 formed at the outer circumferential side. An oil returning hole 19 is formed in the bearing frame 9 at a position inside the diameter of the oldham's coupling 12.

A reference numeral 20 designates a motor rotor, a numeral 21 designates a motor stator, a numeral 22 designates a shell, a numeral 23 designates an oil reservoir formed at the bottom of the shell 22, a numeral 24 designates an inlet pipe, a numeral 25 designates a discharge pipe, and a numeral 26 designates a bearing for the oscillatable scroll member which is eccentric to the axial center of the main shaft 6 and is placed in an eccentric hole 27 formed in an large diameter portion 6*a* of the main shaft 6. A shaft 2*c* extending from the lower surface of the base plate 2*b* of the oscillatable scroll member is rotatably fitted in the bearing 26. A numeral 28 designates a first main bearing for supporting the large diameter portion 6*a* of the main shaft 6, a numeral 29 designates a second main bearing for supporting a small diameter portion 6*b* of the main shaft 6, a numeral 30 designates a first thrust bearing for supporting the base plate 2*b* of the oscillatable scroll member 2. The first thrust bearing 30 is placed between the base plate 2*b* of the oscillatable scroll member 2 and the bearing frame 9 in the vicinity of the first main bearing 28 so as to support a portion near the center of the base plate 2*b*. A second thrust bearing 31 is placed between the lower surface of the large diameter portion 6*a* of the main shaft 6 and the upper surface of the bearing frame 10 so as to support the main shaft 6. An oil feeding port 32 is formed in the main shaft so as to be eccentric to and along the axial center of the main shaft 6 so that oil is fed through the opening 33 formed in the lower end of the main shaft 6 to the bearings 26, 29. A reference numeral 34 designates a gas vent hole formed in the main shaft 6 and a numeral 35 designates an oil returning hole formed in the bearing frame 10.

The stationary scroll member 1 is fastened to the bearing frames 9, 10 by bolts. A suitable fastening method such as press-fitting, shrink-fitting, screw-fitting and so on is used to fix the motor rotor 20 to the main shaft 6 and to fix the motor stator 21 to the bearing frame 10. The oil cap 7 may be fixed to the main shaft 6 by press-fitting or shrink-fitting.

The operation of the conventional scroll-type fluid transferring machine will be described.

When the motor rotor 20 is rotated, sliding movement of the first and second pawls 13, 14 of the oldham's coupling 12 is effected in the first and second grooves 15, 16 by means of the main shaft 6, whereby the oscillatable scroll member 2 is subjected to the oscillation of revolution, but not subjected to rotation; thus, compression of gas is initiated according to the principle of the operation as explained with reference to FIG. 3. In this case, a refrigerant gas is sucked in the shell 22 through the inlet pipe 24 and is passed through air gaps between the bearing frame 10 and the motor stator 21 and between motor rotor 20 and motor stator 21 as shown by solid arrow marks, whereby cooling of the motor is effected. The refrigerant gas is then passed through an air gap between the shell 22 and the bearing frames 9, 10 to be sucked in the compression chamber 5 through the intake port 3 formed in the stationary scroll member 1. The refrigerant gas compressed in the compression chamber 5 is discharged from the compressor through the outlet port 4 via the discharge pipe 25.

A lubricating oil is supplied from the oil reservoir 23 through the oil cap 7 and the oil feeding port 32 provided in the main shaft 6 to the bearings 26, 29 by the function of a centrifugal pump to effect lubrication of the bearings 26, 29, followed by lubricating of the bearings 28, 30 and 31. The lubrication oil is then returned to the oil reservoir 15 through the oil returning holes 19, 35 formed in the bearing frames 9, 10. As an expedient for preventing the lubricating oil which has lubricated the bearing 31 and so on from being sucked into the intake port 3, a contacting area is provided between the upper surface of the oldham's coupling ring 12 and the lower surface of the base plate **2*b* of the oscillatable scroll member 2, and the gap formed in the contacting area is minimized. Further, the intake port (intake chamber) 3 is isolated from sliding elements by minimizing the gaps in the contacting area of the pawls 13, 14. The gas vent hole 34 formed in the main shaft 6 increases pump efficiency by quickly discharging the gas in the oil gap 7** outside the shaft during the operations of the machine.

In order to avoid a reduction in performance of the scroll-type fluid transferring machine, it is desirable to minimize the pressure loss at the intake port formed at the outer circumferential part of the stationary scroll member 1. However, when the scroll-type machine is used as a compressor for air-conditioning or refrigerating in which a refrigerant is contained, retention of the refrigerant in the shell is inavoidable. When the scroll-machine is turned on in the presence of the refrigerant in the shell, there results an abnormal rise in a discharging pressure which can cause breakage of the compressor or otherwise actuation of a safety device, a pressure switch and so on to protect a piping circuit for the compressor. For this reason, it is also desirable to increase the pressure loss at the intake port. The above-mentioned requirements contradict each other, and therefore one has to be sacrificed. In the case that the pressure loss in the intake port is made greater, a fluid pressure between the wraps becomes lower than the inner pressure of the shell by the magnitude corresponding to the pressure loss, with the consequence that the lubricating oil which has lubricated the bearings under a pressure substantially same as the inner pressure of the shell and has flowed into the first space 17 of the recess 11 of the bearing frame 9 is easily taken into the compression chamber via second space 18 thereby increasing an oil consumption.

SUMMARY OF THE INVENTION

It is an object of the present invention to provide a scroll-type fluid transferring machine which suppresses abnormal rise in pressure at the discharge side at the starting time, without causing reduction in performance, rise in the oil level and retention of a refrigerant gas.

The foregoing and the other objects of the present invention have been attained by providing a scroll-type fluid transferring machine comprising a stationary scroll member and an oscillatable scroll member, both having a wrap, which cooperate to form a compression chamber between the wraps by mutually fitting one into the other; an intake port formed at the outermost part of the wrap of the stationary scroll member; a main shaft for driving the oscillatable scroll member by the aid of a bearing member for supporting the oscillatable scroll member to thereby compress a fluid sucked through the intake port; a motor for driving the main shaft; a thrust bearing for supporting the lower surface of the base plate of the oscillatable scroll member; a bearing frame provided with a main bearing portion for supporting the main bearing and the main shaft; an oldham's coupling which has an annular ring portion, first pawls formed on the upper surface of the annular ring portion, second pawls formed on the lower surface of the annular ring member so that lines diametrically extending between the first and second pawls orthogonally intersect and which connects the lower surface of the base plate of the oscillatable scroll member to the bearing frame by means of the first and second pawls, whereby the oscillatable scroll member is subjected to the movement of revolution; a shell having the upper portion in which the stationary and oscillatable scroll members are arranged, the lower portion in which the motor is arranged and the bottom portion as an oil reservoir containing a lubricating oil in which the lower end of the main shaft is immersed; an oil feeding port formed in the main shaft to feed the lubricating oil to elements to be lubricated; an oil returning port formed in the bearing frame at a position inside the moving area of the oldham's coupling so that the lubricating oil is returned to the oil reservoir after the thrust bearing has been lubricated; and the annular ring member of the oldham's coupling for isolating the oil returning port from the intake port formed in the compression chamber, characterized in that a communication hole is formed in the side wall of the bearing frame to communicate a low pressure space in the shell with a space at the intake port side which is defined by a recess formed in the bearing frame, the annular ring member of the oldham's coupling, the base plate of the oscillatable scroll member and the lower surface of the stationary scroll member.

DETAILED DESCRIPTION OF THE PREFERRED EMBODIMENTS

An embodiment of the present invention will be described with reference to the accompanying drawings.

Figure 1:
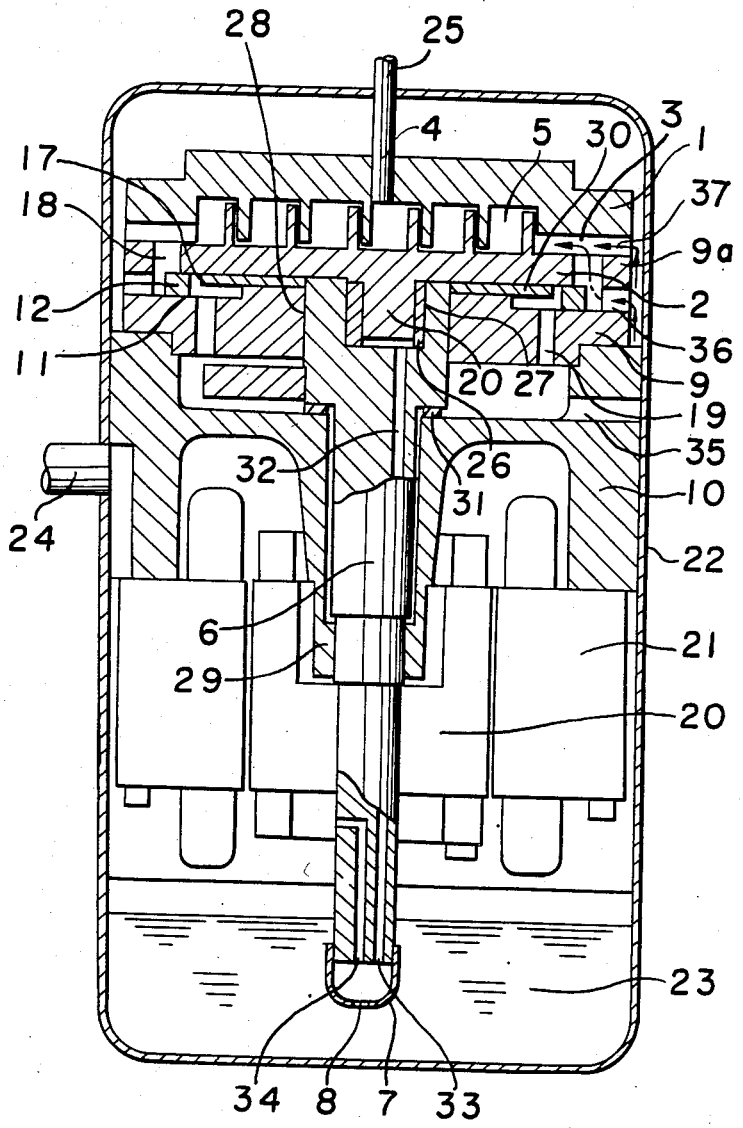
FIG. 1 is a cross-sectional view showing an embodiment of the scroll-type fluid transferring machine of the present invention.

FIG. 1 is a cross-sectional view of an embodiment of the present invention, in which reference numerals 1 to 35 designate the same or corresponding parts. In this embodiment, a cross-sectional area of the first passage 37 of the intake port 3 formed in the stationary scroll member is made smaller than that of the conventional machine. A throttle portion may be formed in the passage of the inlet port. A second passaged in the form of a plurality of communication holes 36 are formed in the side surface 9*a* of the bearing frame 9 to communicate a low pressure space in the shell with the second space formed in the outer circumferential portion of the oldham's coupling.

Description will be made as to the scroll-type fluid transferring machine having the above-mentioned construction in a case that the machine is utilized as a refrigerant compressor for refrigerating or airconditioning.

Rotation of the motor rotor 20 initiates the oscillation of the oscillatable scroll member 2 by means of the main shaft 6 whereby the refrigerant is passed through the first passage 37 communicated with the intake port 3 (as shown by solid arrow marks) and the second passage formed in part by the communication hole 36 (as shown by broken arrow marks) to be sucked in the compression chamber 5. In the compression chamber 5, the volume of the refrigerant gas is gradually reduced and is finally discharged through the outlet port 4. Accordingly, even when a large quantity of the refrigerant gas enters in the shell, a sinusoidal throttling effect is obtained in the second passage at the time of starting of the machine, whereby sudden supply of a large amount of the refrigerant into the compression chamber is avoided and a stable starting operation can be obtained.

The lubricating oil sucked through the oil cap 7 is supplied to the bearings to lubricate them and is discharged into the first space 17 formed inside the oldham's coupling 12. In this case, the second space 18 formed outside the oldham's coupling 12 which is communicated with the inlet port 3 is equal in pressure to the low pressure space by means of the communication holes 36. Accordingly, there is no substantial pressure difference between them, and the lubricating oil stored in the first space 17 is forwarded to the oil returning hole 19 to be returned to the oil reservoir 23 without causing leakage of it into the second space 18.

The above-mentioned operations will be described with reference to FIG. 2.

Figure 2:
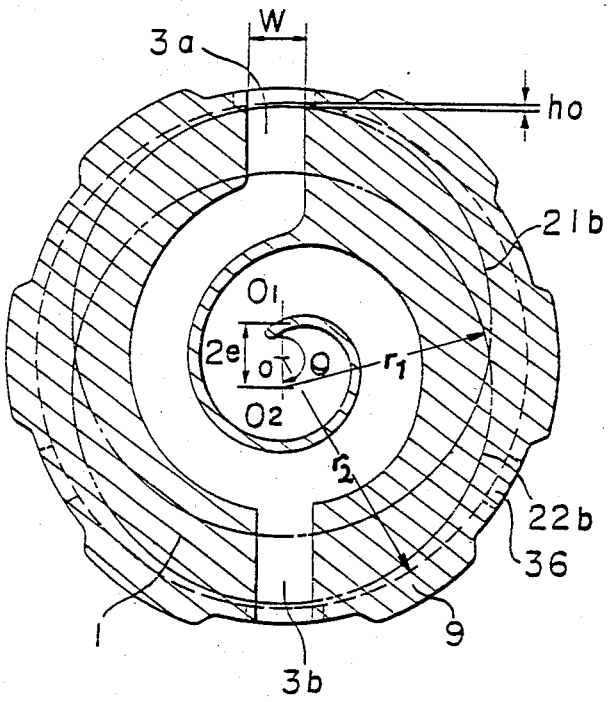
FIGS. 2(*a*) and 2(*b*) show the principle of the present invention.
Figure 2:
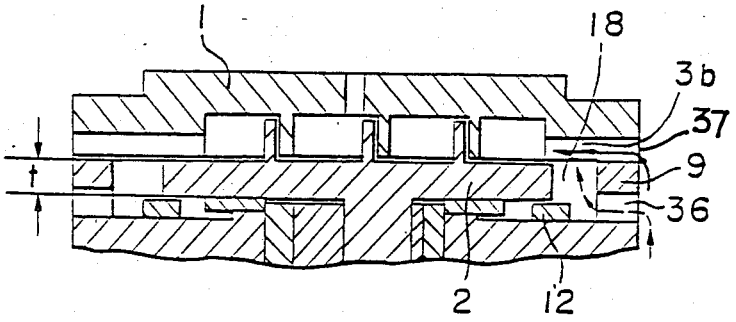
Figure 3:
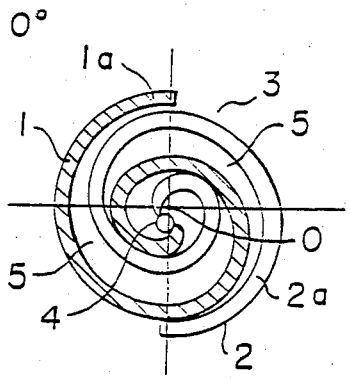
FIG. 3 (*c*) through 3(*d*) are diagrams showing the principle of operation of a scroll-type fluid transferring machine.
Figure 3:
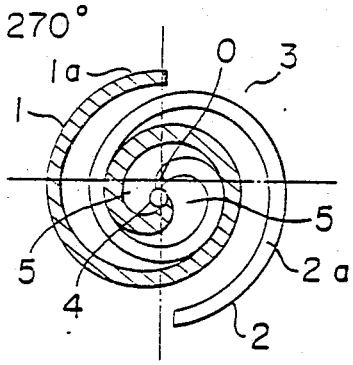
Figure 3:
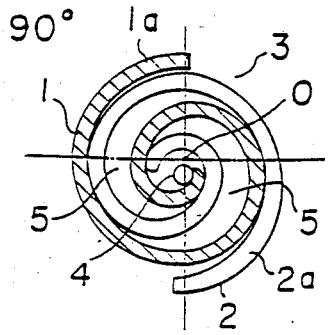
Figure 3:
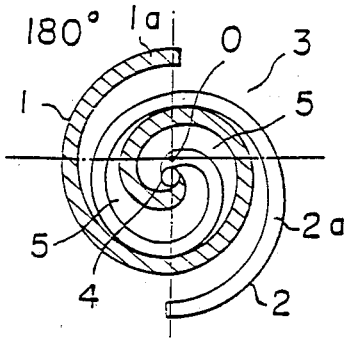
Figure 4:
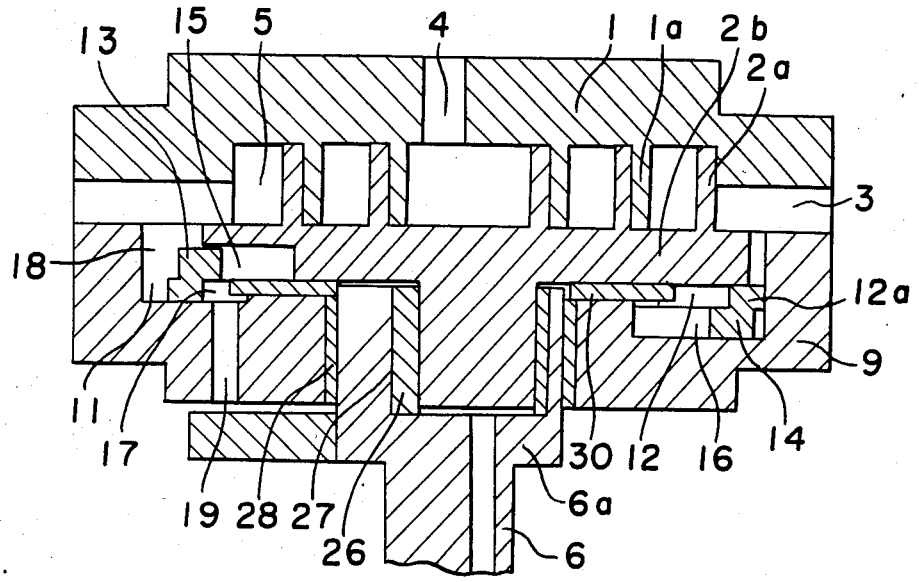
FIGURE 4 PRIOR ART
FIG. 4 is a longitudinal cross-sectional view of an important part of a conventional scroll-type fluid transferring machine.

FIG. 2 is a diagram of the stationary scroll member when it is viewed from above, in which a hatched portion surrounded by solid lines designates the stationary scroll member. The bearing frame 9 with a plurality of the communication holes 36 in its side wall is designated by a broken line, and reference numerals 21*b*, 22*b* show a range in which the base plate of the oscillatable scroll member can be moved in the vertical direction in FIG. 2*a*. A symbol O represents the center of the bearing frame, a symbol $O_1$ represents the center of the base plate 21*b* of the oscillatable scroll member, a symbol $O_2$ represents the center of the base plate 22*b*, and a symbol e represents a radius in a crank movement of the main shaft.

FIG. 2*b* is a cross-sectional view taken along the center line of the intake ports 3*a*, 3*b* of the stationary scroll member 1 shown in the plan view of FIG. 2*a*, in which said arrow marks indicate a flow of gas sucked into the intake port 3*b* of the stationary scroll member, and broken arrow marks indicate a flow of the gas sucked through a communication hole 36 formed in the bearing frame 9. The communication hole 36 constitutes the second passage which is formed by the low pressure space in the shell, a space in the outer circumferential part of the oldham's coupling and the intake port 3. The minimum air gap $h_0$ in the second passage is determined by the first intake port 3*a* or 3*b* formed in the stationary scroll member, the bearing frame 9 and the base plate 2*b* of the oscillatable scroll member.

The area S of a second passage in which the minimum air gap $h_0$ is formed can be expressed as follows.

$$S = r_2^2\left(\frac{1}{2}\sin 2\theta_1 + \theta_1\right) - \left[\left\{\frac{r_1^2}{2}\left(\frac{1}{2}\sin 2\theta_2 + \theta_2\right) + br_1\sin\theta_2\right\} + \left\{\frac{r_1^2}{2}\left(\frac{1}{2}\sin 2\theta_3 + \theta_3\right) + br_1\sin\theta_3\right\}\right]$$

$$\theta_1 = \sin^{-1}\left(\frac{W}{2r_2}\right)$$

$$\theta_2 = \sin^{-1}\left(\frac{W - 2a}{2r_1}\right)$$

$$\theta_3 = \sin^{-1}\left(\frac{W + 2a}{2r_1}\right)$$

$$a = e\cos\theta$$
$$b = e\sin\theta$$

$$a = e\cos\theta$$
$$b = e\sin\theta$$

where W is the width of the intake port formed in the stationary scroll member, $h_0$ is the minimum air gap formed between the outer periphery of the base plate of the oscillatable scroll member and the inner periphery of the recess of the bearing frame, $r_1$ is the radius of the base plate of the oscillatable scroll member, $r_2$ is the radius of the recess of the bearing frame 9, e is the radius of oscillating movement of the oscillatable scroll member, $\theta$(rad) is the revolution angle of the oscillatable scroll member and the axial line of the oscillatable scroll member passes the center of the intake port when $\theta=0$. Accordingly, the area S assumes the minimum value when $\theta=0$ and assumes the maximum value when $\theta=\pi$, which provides a sinusoidal change in the area of the passage. Accordingly, by forming the second passage which causes a pressure loss of a sinusoidal form to the first passage which is formed in the stationary scroll member, the throttling function in the first passage becomes gentle. Further, the sinusoidal change of the pressure loss provides low and high flows of the sucked gas. Under the low flow condition a large amount of refrigerant is not introduced in the compression chamber.

Experiments were conducted to study relation between a reduced area portion $S_1$ of the first passage and the minimum area $S_2$ in a reduced area portion of the second passage.

Figure 6:
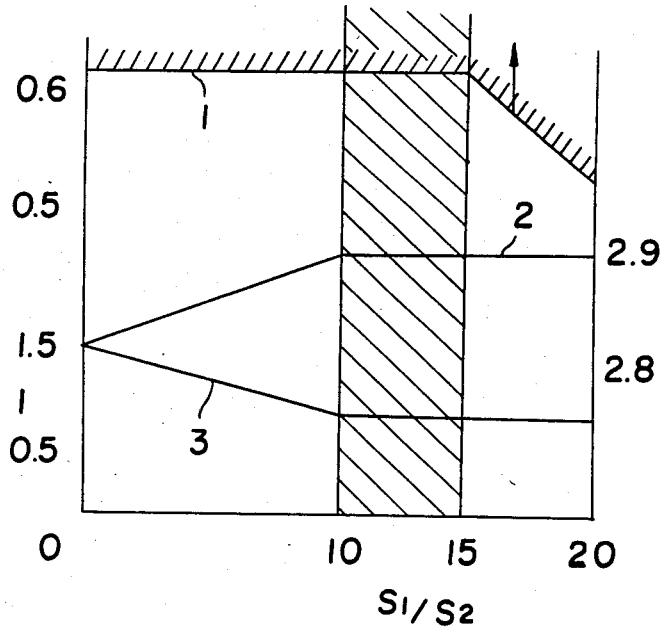
FIG. 6 is a diagram showing relation between dimensions of the essential elements used in the present invention and coefficient of performance.
Figure 5:
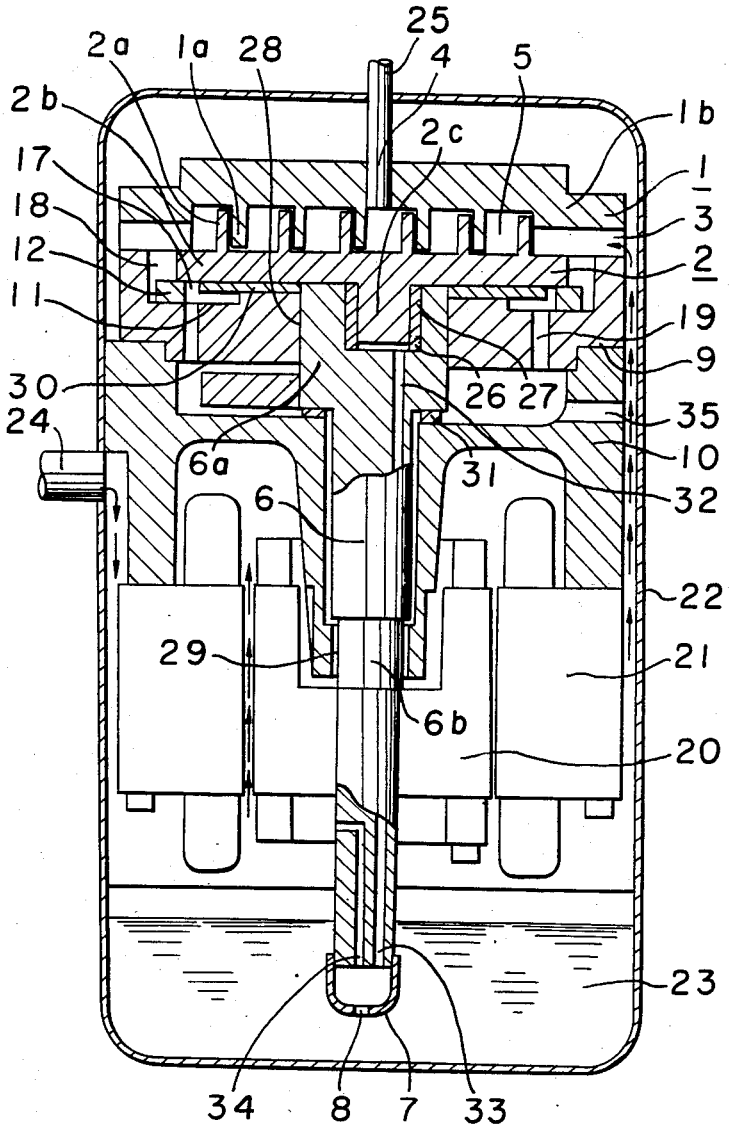
FIGURE 5 PRIOR ART
FIG. 5 is a longitudinal cross-sectional view of the conventional scroll-type fluid transferring machine.

FIG. 6 is a diagram based on the results by the experiments. In FIG. 6, the abscissa represents a $S_1/S_2$ ratio. In the ordinate, 1 indicates a line of an admissible flow rate of a refrigerant in which the upper region of the line 1 causes abnormal rise in pressure of discharged gas and operates a high pressure switch; 2 indicates a curve of coefficient of performance (COP); and 3 indicates oil level. It is apparent from the figure, $S_1/S_2$ should be equal to or greater than 10 in order to increase COP and to reduce the oil level whereas $S_1/S_2$ should be equal to or smaller than 15 in order to suppress abnormal rise in pressure of the discharged gas. Accordingly, it is possible to prevent an abnormal rise in pressure of the discharged gas at the time of starting without decrease of the COP and the oil level when $10 \leqq S_1/S_2 \leqq 15$.

Since the lower pressure space in the shell is communicated with the space formed in the outer circumferential part of the oldham's coupling by means of the communication hole, pressure difference between the inner and outer spaces which are separated by the oldham's coupling can be minimized. Accordingly, the pressure difference can be only the difference in pressure head in the main shaft pump thereby minimizing the quantity of the lubricating oil leaked from the space in the inner circumferential part to the space of the outer circumferential part of the oldham's coupling.

Thus, in the present invention, leakage of the lubricating oil to a fluid circuit can be reduced by providing the communication hole formed in the side wall of the bearing frame, which communicates the space in the shell and the space in the outer circumferential part of the oldham's coupling. In addition, an abnormal rise in pressure of a gas at the starting time under the condition that the refrigerant enters in the compression chamber can be eliminated by forming a throttling portion in the intake port of the stationary scroll member. Accordingly, reduction in performance of the machine can be prevented.

Further, an intake part for feeding a gas into a compression chamber formed between wraps of the stationary and oscillatable scroll members is constituted at the outer peripheral part of the wrap of the stationary scroll member, a recess of a bearing frame, a base plate of the oscillatable scroll member and the lower surface of the stationary scroll member, in which a $S_1/S_2$ ratio is given to be $10 \leqq S_1/S_2 \leqq 15$, where $S_1$ is a minimum area in cross-section of the intake port and $S_2$ is the minimum area of the second passage. Accordingly, an abnormal rise in pressure of the discharged gas at the starting time of the machine can be prevented without causing reduction in coefficient of performance.

We claim:

1. A scroll type fluid transferring machine comprising:

a shell;

means for defining a stationary scroll member in said shell;

means for defining an oscillatable scroll member having a wrap cooperating with a wrap of said stationary scroll member to form a compression chamber;

bearing frame means in said shell for supporting said oscillatable scroll member for oscillation;

means for causing said oscillatable scroll member to oscillate, including an oldham's coupling having an oscillating ring member in a recess of said bearing frame means;

intake port means for feeding a fluid to said compression chamber, whereby said fluid may be compressed in said compression chamber during oscillation of said oscillatable scroll member;

outlet port means for discharging the compressed fluid from said shell;

means for supplying lubricant to said recess of said bearing frame means;

means for introducing the fluid into said shell;

means for defining a first passage in said stationary scroll member between a low pressure portion of the interior of said shell in communication with the fluid from said means for introducing and said intake port means; and means for defining a second passage in said bearing frame means between said low pressure portion of said shell and said intake port means, said second passage having a sectional area varying as a function of a position of oscillation of said oscillatable scroll member.

2. A scroll-type fluid transferring machine according to claim 1, wherein a $S_1/S_2$ ratio is $10 \leqq S_1/S_2 \leqq 15$, where $S_1$ is the area in cross-section of said first passage means and $S_2$ is the minimum area in cross-section of said second passage means.

3. The machine of claim 1 wherein said means for defining a second passage comprise a plurality of communication holes in said bearing frame means.

* * * * *